United States Patent [19]

Bräuer et al.

[11] Patent Number: 4,773,831

[45] Date of Patent: Sep. 27, 1988

[54] DIAPHRAGM PLUNGER PUMP

[75] Inventors: Rüdiger Bräuer, Hamburg; Dirk Petersen, Travenbrück; Peter Wente, Wedel, all of Fed. Rep. of Germany

[73] Assignee: Bran & Luebbe GmbH, Norderstedt, Fed. Rep. of Germany

[21] Appl. No.: 35,904

[22] Filed: Apr. 2, 1987

[30] Foreign Application Priority Data

Feb. 28, 1987 [EP] European Pat. Off. ..... 87102867.6

[51] Int. Cl.[4] ..... F04B 9/10

[52] U.S. Cl. ..... 417/387

[58] Field of Search ..... 417/383, 387

[56] References Cited

U.S. PATENT DOCUMENTS

| | | | |
|---|---|---|---|
| 3,149,469 | 9/1964 | Williams | 417/387 X |
| 3,910,727 | 10/1975 | Flynn et al. | 417/387 |
| 4,116,590 | 9/1978 | Prestwick | 417/387 |

FOREIGN PATENT DOCUMENTS

| | | | |
|---|---|---|---|
| 197481 | 11/1983 | Japan | 417/387 |
| 486142 | 1/1976 | U.S.S.R. | 417/387 |
| 522338 | 9/1976 | U.S.S.R. | 417/387 |
| 727871 | 4/1980 | U.S.S.R. | 417/383 |

*Primary Examiner*—Leonard E. Smith
*Attorney, Agent, or Firm*—Michael J. Striker

[57] ABSTRACT

A diaphragm plunger pump comprises a housing, element forming a pump chamber associated with the housing, a plunger working chamber arranged to be filled with hydraulic fluid during operation, a sealingly clamped diaphragm separating the pump chamber from the plunger working chamber, a plunger sealing displaceable in the plunger working chamber for alternating stoke plunger working chamber for alternating stroke deflection of the diaphragm, a supply chamber for hydraulic liquid and connectable with the plunger working chamber, a valve arranged to connect the supply chamber with the working chamber, the plunger having a central opening provided with a valve seat and serving for communication of the plunger working chamber with the supply chamber, the valve having a valve body which cooperates with the valve seat and is coaxially displaceable relative to the latter, element for sealingly pressing the valve body against the valve seat, and abutment element arranged to lift the valve body from the valve seat when the plunger is at less than a predetermined axial distance from its rear dead point.

7 Claims, 2 Drawing Sheets

DIAPHRAGM PLUNGER PUMP

BACKGROUND OF THE INVENTION

The present invention relates to a diaphragm plunger pump. More particularly, it relates to a diaphragm plunger pump which has a housing, a feeding chamber, a plunger working chamber which in operative condition is filled with hydraulic fluid, a sealingly clamped diaphragm which separates the feeding chamber from the plunger working chamber, a plunger which is sealingly displaceable in the plunger working chamber for alternating stroke deflection of the diaphragm, a supply chamber for hydraulic fluid connected with the plunger working chamber via at least one valve, and devices for adjusting the feeding quantity.

Diaphragm plunger pumps of the above mentioned general type are known in the art. One of such diaphragm plunger pumps is disclosed, for example, in the German document DE-AS No. 1,453,579. In this diaphragm plunger pump a bore extending parallel to the cylindrical plunger working chamber is provided. It communicates via a communicating passage with the membrane chamber and is connected with the supply chamber in an axial distance from said passage. A sleeve provided with a concentric bore is axially displaceable in the above mentioned parallel bore and is sealed on its periphery by three ring seals. A sliding rod is connected with the plunger via a dead travel connection and guided in the above concentric bore for joint movement. The sliding rod releases an opening in the sleeve communicating with the communicating passage during the suction stroke shortly before the rear dead point position of the plunger and thereby connects the plunger working chamber which is filled with hydraulic fluid with a transmission housing which serves as a supply chamber and is under outer pressure.

Since the metal sliding rod which is connected with the plunger in a laterally offset manner and slides in the sleeve does not reliably seal, leakages occur in dependence upon the operating temperature, the viscosity of the hydraulic fluid, and the difference pressure between the working chamber and the supply chamber. They undesirably affect the feeding accuracy of the diaphragm pump. Moreover, three seals are needed on the sleeve which is displaceable for adjustment of the feeding stream, of which two seals are loaded dynamically by the pulsating pressure between the suction stroke and the pressure stroke.

SUMMARY OF THE INVENTION

Accordingly, it is an object of the present invention to provide a diaphragm plunger pump which avoids the disadvantages of the prior art.

More particularly, it is an object of the present invention to provide a diaphragm plunger pump which eliminates undesirable leakages and provides for a higher dosing accuracy, with a simple and inexpensive construction.

In keeping with these objects and with others which will become apparent hereinafter, one feature of the present invention resides, briefly stated, in a diaphragm plunger pump in which a plunger has a central opening which is provided with a valve seat and communicates the plunger working chamber with the supply chamber, a valve body which cooperates with the valve seat and is displaceable coaxially therewith, a device for sealingly pressing the valve body against the valve seat, and abutment means arranged to lift the valve body when the plunger is at less than a predetermined axial distance from its rear dead point, from the valve seat of the plunger.

When the diaphragm plunger pump is designed in accordance with the present invention, it can be produced with lower expenses because of its simple construction, it includes a minimum of seals, and it is designed with coaxial arrangement of the plunger, the valve seat, the valve body and the guide so as to provide a wear-free operation with substantially improved sealing without affecting the feeding stream adjustment.

Depending on the dimension or the adjustment of the abutment means relative to the guidance of the valve body, the abutment means lifts the valve body from the valve seat during the movement of the plunger and in particular during the suction stroke when the plunger is at less than a predetermined distance from its rear dead point position. Thereby a direct connection between the plunger working chamber and the supply chamber for hydraulic fluid is provided, so that the further movement of the plunger till it reaches its rear dead point position does not cause any further deflection of the membrane.

By the displacement of the guiding sleeve, for example by means of a threaded sleeve provided with an adjustment button, the feeding stream of the diaphragm plunger pump can be adjusted, for example between 100% and 25%. When a displacement projection is provided on the valve body and extends into the central opening of the plunger, it forms together with the wall of the central opening an annular gap during the closing and opening of the valve body and insures a stable initial position of the diaphragm on the abutment surface facing away from the feeding chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
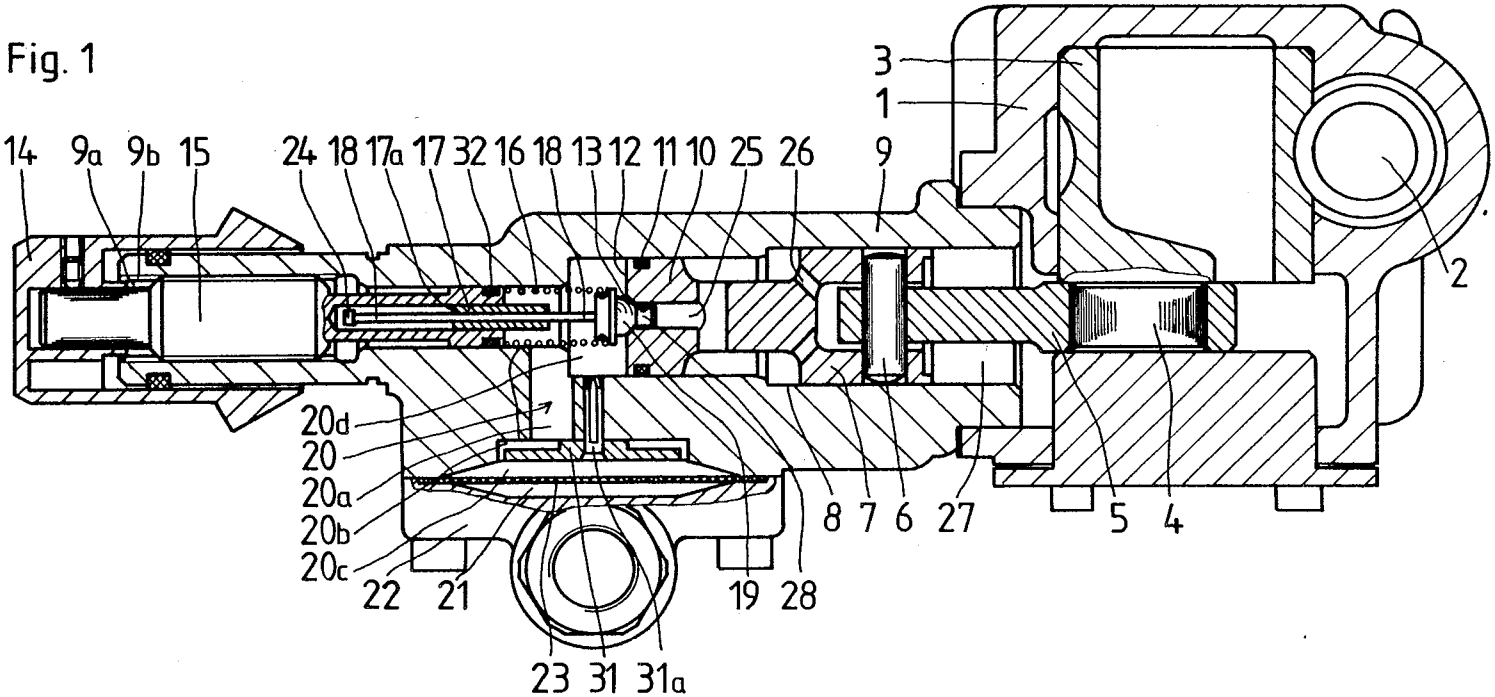
FIG. 1 is a view showing a longitudinal section of the diaphragm plunger pump in accordance with the present invention.

A diaphragm plunger pump in accordance with the present invention has a pump housing 9. A transmission housing 1 is connected with the pump housing 9 and accommodates a worm wheel 3 which is rotatably supported in the transmission housing 1 and driven by a worm shaft 2. The pump housing 9 forms a cylindrical chamber 20*d* in which a plunger 10 provided with a seal 11 is guided in an axially displaceable manner. The plunger 10 carries a cross hole head 7 which is connected, via a cross hole head pin 6, with a plunger rod 5 which surrounds an eccentric 4. In this manner the rotation of the worm shaft 2 is converted into a reciprocating movement of the plunger 10.

The plunger 10 has a valve seat 13 centrally provided on its end surface 12, and also a central opening 25. A cover 22 is releasably mounted on one side of the pump housing 9 by means of threaded members. A diaphragm 23 is clamped between the pump housing 9 and the cover 22 with its peripheral edge in a hermetically sealing manner. The diaphragm separates a pump chamber 21 provided with inlet and outlet passages which are not shown in the drawing, from a plunger working chamber 20. The plunger working chamber 20 includes the cylinder chamber 20*d* limited by the end surface 12 of the plunger 10, and a diaphragm chamber 20*c* which communicates with the cylinder chamber 20*d* via a transverse passage 20*a* and an annular gap 20*b*. During a suction stroke, the diaphragm 23 abuts against a supporting plate 31 which is held in the pump housing 9 by a guiding pin 31*a*.

A threaded spindle 15 is screwed into an opening 9*a* which is provided with an inner thread 9*b* and extends coaxially to the cylinder chamber 20*d*. At the end projecting from the pump housing 9, the threaded spindle 18 is provided with an adjusting button 14 for joint rotation. The threaded spindle 15 is provided at its end facing toward the plunger 10, with a central blind hole in which a guiding sleeve 17 is fixed. A valve rod 18 is displaceably guided in the guiding sleeve 17 and supports a valve body 19 at its end facing toward the plunger 10. The valve body 19 is tightly pressed by a helical spring 16 against the valve seat 13 of the plunger 10.

The valve rod 18 has an abutment projection 24 on its end which is remote from the valve body 19. The abutment projection 24 engages the guiding sleeve 17 and more particularly its end surface 17*a* which faces away from the plunger 10, and thereby limits the displacement of the valve rod 18 and the valve body 19 in direction toward the plunger 10. The valve body 19 carries a displacement projection 28 which extends in the closed position of the valve body 19 into the opening 25 and is provided with a bevel 29. The displacement projection 28 is cylindrical or slightly conical. During the opening and closing movement of the valve body 19 the displacement projection 28 forms an annular gap 30 with the surrounding wall of the opening 25. During the pressure stroke the hydraulic fluid is displaced in dependence upon the pressure in the plunger working chamber 20 from the latter into a transmission chamber 27 which serves as a supply chamber so as to insure a stable, reproducible initial position of the diaphragm 23 on the supporting plate 31. At least one connecting passage 26 is provided in the cross hole head 7.

Figure 2:
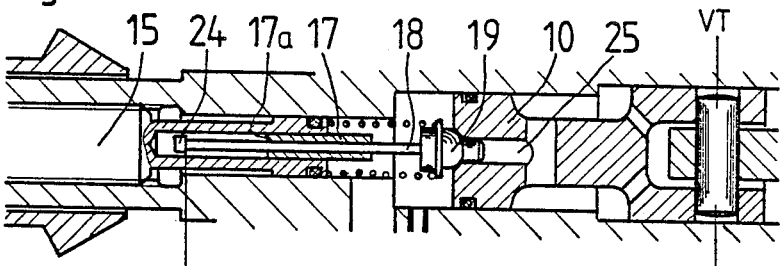
FIG. 2 is a schematic partial view of diaphragm plunger pump of FIG. 1, in the front dead point position of the plunger.
Figure 3:
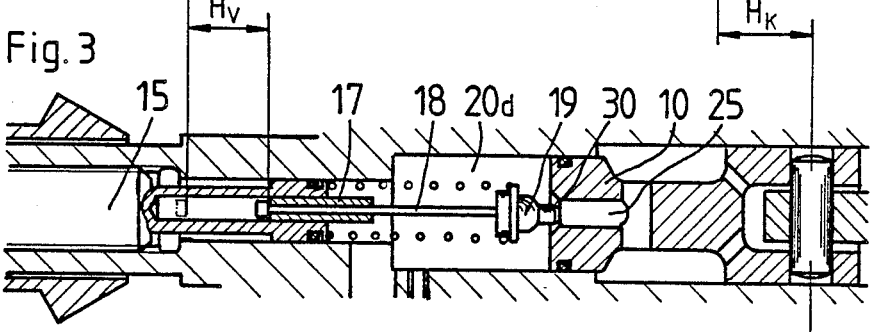
FIG. 3 is a schematic partial longitudinal section of the diaphragm plunger pump of FIG. 1, in the rear dead point position of the plunger.

When the plunger 10 during the suction stroke is moved back from its front dead point position VT shown in FIG. 2, the valve body 19 is first held by the pressure spring 16 in its position in which it is sealingly abutted against the valve seat 13 and follows, under the displacement of the valve rod 18 in the guiding sleeve 17, the movement of the plunger 10, until the abutment projection 24 of the valve rod 18 after its maximal stroke HV abuts against the rear abutment surface 17*a* of the guiding sleeve 17. In this position which is achieved before the end of the full plunger stroke $H_K$ as shown in FIG. 3, shortly before the rear dead point position HT of the plunger 10, the valve body 19 is prevented from further joint movement on the plunger 10 and is lifted from the valve seat 13. Thereby the cylinder chamber 20*d* is connected with the transmission chamber 27 formed as a supply chamber, via an annular gap 30 between the displacement projection 28 and the valve seat 13 or the peripheral wall of the opening 25, as well as via the opening 25.

When the plunger 10 then moves forwardly during the subsequent pressure stroke from its rear dead point position HT, it abuts with the valve seat 13 again sealingly against the valve body 19 and moves then the valve body 19 against the force of the helical pressure spring 16 with a rearward displacement of the valve rod 18 in the guiding sleeve 17 in direction toward its front dead point position VT. Thereby the valve body 19 abuts during the main part of the pressure stroke sealingly against the valve seat 13.

Figure 4:
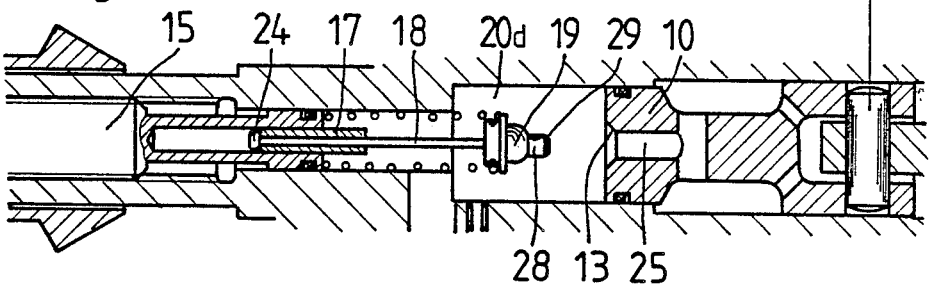
FIG. 4 is a schematic partial longitudinal section of the diaphragm plunger pump of FIG. 1, in the rear dead point position of the plunger with the position of the guiding sleeve which adjusts the feeding stream to 25% of the maximum.

By turning of the threaded spindle 15 by means of the adjusting button 14, the guiding sleeve 17 can be displaced for example to the position shown in FIG. 4. Thereby the abutment projection 24 during the suction stroke comes into abutment against the abutment surface 17*a* of the guiding sleeve 17 after a relatively short joint movement of the valve body 19 with the plunger 10 and causes a lifting of the valve body 19 from the valve seat 13. During the subsequent greater part of the suction stroke, the plunger working chamber 20 is connected with the transmission chamber 27. The valve body closes during the pressure stroke only after the plunger 10 has covered the greater part of its forward movement, so that the part of the plunger stroke which determines the supply stream forms only 25% of the maximum supply flow in the position of the guiding sleeve 17 shown in FIG. 2. It is to be understood that the guiding sleeve 17 can be adjusted in dependence upon the requirements to any arbitrary intermediate position, for respectively regulating the supply stream.

The above described diaphragm plunger pump requires, in addition to the seal 11 of the plunger 10, only one seal 32 on the threaded spindle 15. It makes possible a stepless adjustment of the supply stream without additional adjustment of the plunger stroke. Because of the coaxial arrangement of the valve body 19, valve rod 18, guiding sleeve 17 with respect to the plunger 10, a reliable wear-free sealing is obtained without undesirable leakage and thereby an improved dosing accuracy is provided, regardless of the operational temperature, the viscosity properties of the hydraulic fluid, and the respective pressure in the plunger working chamber 20. The above described diaphragm plunger pump can be modified in accordance with the requirements in different ways, as long as the coaxial arrangement of the plunger, valve seat, and valve body is maintained.

It will be understood that each of the elements described above, or two or more together, may also find a useful application in other types of constructions differing from the types described above.

While the invention has been illustrated and described as embodied in a diaphragm plunger pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A diaphragm plunger pump, comprising a housing; means forming a pump chamber associated with said housing; a plunger working chamber arranged to be filled with hydraulic fluid during operation; a sealingly clamped diaphragm separating said pump chamber from said plunger working chamber; a plunger having a longitudinal axis and being sealingly displaceable in said plunger working chamber for alternating stroke deflection of said diaphragm; a supply chamber for hydraulic liquid connectable with said plunger working chamber, said plunger having a central opening provided with a valve seat and serving for communication of said plunger working chamber with said supply chamber; a valve rod accommodated in said plunger working chamber for limited movement coaxial to said plunger; a valve body disposed at the end of said valve rod facing towards the plunger and cooperating wtih said valve seat; spring means accommodated in said plunger working chamber for sealingly pressing said valve body against said valve seat and supported on said housing; abutment means for limiting the movement of said valve rod in the direction towards said plunger to lift said valve body from said valve seat when said plunger is at less than a predetermined axial distance from its rear dead point.

2. A diaphragm plunger pump, comprising a housing; means forming a pump chamber associated with said housing; a plunger working chamber arranged to be filled with hydraulic fluid during operation; a sealingly clamped diaphragm separating said pump chamber from said plunger working chamber; a plunger having a longitudinal axis and being sealingly displaceable in said plunger working chamber for alternating stroke deflection of said diaphragm; a supply chamber for hydraulic liquid connectable with said plunger working chamber, said plunger having a central opening provided with a valve seat and serving for communication of said plunger working chamber with said supply chamber; a valve rod accommodated in said plunger working chamber for limited movement coaxial to said plunger; a valve body disposed at the end of said valve rod facing towards the plunger and cooperating with said valve seat; spring means accommodated in said plunger working chamber for sealingly pressing said valve body against said valve seat; abutment means for limiting the movement of said valve rod in the direction towards said plunger to lift said valve body from said valve seat when said plunger is at less than a predetermined axial distance from its rear dead point; and a guiding sleeve accommodated in said plunger working chamber and coaxial with said plunger.

3. A diaphragm plunger pump as defined in claim 2, wherein said spring means abuts against said guiding sleeve.

4. A diaphragm plunger pump as defined in claim 2; and further comprising a threaded spindle connected with said guiding sleeve and rotatably guided in said housing, said spring means being supported on said threaded spindle.

5. A diaphragm plunger pump as defined in claim 2, wherein said opening in said plunger has a wall, said valve body having a displacement projection which in a closed position in which said valve body abuts against said valve seat extends into said central opening of said plunger, and during opening and closing movements of said valve body forms an annular gap between said displacement projection and said wall of said central opening.

6. A diaphragm plunger pump as defined in claim 5, wherein said displacement projection of said valve body is cylindrical.

7. A diaphragm plunger pump as defined in claim 5, wherein said displacement projection of said valve body is slightly conical.

* * * * *